US006233777B1

(12) United States Patent
Kresse et al.

(10) Patent No.: US 6,233,777 B1
(45) Date of Patent: May 22, 2001

(54) FLAT FLOOR-MOP-TYPE COVERING WITH PERIPHERAL BRUSH RING

(75) Inventors: Franz Kresse, Hilden; Klaus-Peter Bansemir, Langenfeld; Heiko Faubel, Wermelskirchen, all of (DE)

(73) Assignee: Henkel-Ecolab GmbH & Co. OHG, Duesseldorf (DE)

( * ) Notice: Subject to any disclaimer, the term of this patent is extended or adjusted under 35 U.S.C. 154(b) by 0 days.

(21) Appl. No.: 09/269,996

(22) PCT Filed: Sep. 25, 1997

(86) PCT No.: PCT/EP97/05258

§ 371 Date: May 4, 1999

§ 102(e) Date: May 4, 1999

(87) PCT Pub. No.: WO98/15221

PCT Pub. Date: Apr. 16, 1998

(30) Foreign Application Priority Data

Oct. 4, 1996 (DE) ..... 196 41 079

(51) Int. Cl.[7] ..... A47L 13/20
(52) U.S. Cl. ..... 15/229.4; 15/229.1; 15/229.8
(58) Field of Search ..... 15/228, 229.1, 15/229.9

(56) References Cited

U.S. PATENT DOCUMENTS

| | | | | |
|---|---|---|---|---|
| 1,940,543 | * | 12/1933 | Hertzberg | 15/229.7 |
| 3,425,085 | * | 2/1969 | Moss | 15/229.4 |
| 3,593,359 | * | 7/1971 | Strauss | 15/229.8 |
| 3,711,885 | * | 1/1973 | Griffin et al. | 15/229.4 |
| 3,711,886 | * | 1/1973 | Strauss | 15/229.8 |
| 3,962,743 | * | 6/1976 | Moss | 15/229.4 |
| 4,644,741 | * | 2/1987 | Gradinger et al. | 15/229.1 X |
| 4,961,242 | | 10/1990 | Kresse et al. | 15/228 |
| 5,522,648 | * | 6/1996 | Wilen | 15/229.4 X |

FOREIGN PATENT DOCUMENTS

| | | | | |
|---|---|---|---|---|
| 462398 | * | 10/1968 | (CH) | 15/229.8 |
| 32 26 947 | | 1/1984 | (DE) . | |
| 38 09 279 | | 7/1989 | (DE) . | |
| 2 035 064 | | 6/1980 | (GB) . | |

* cited by examiner

*Primary Examiner*—Mark Spisich
(74) *Attorney, Agent, or Firm*—Wayne C. Jaeschke; Glenn E. J. Murphy; Kenneth Watov

(57) ABSTRACT

The invention concerns a flat floor-mop-type covering for cleaning floors, with a cover sheet which, on the upper surface, comprises pockets for securing it to a mounting and, in the central region of the lower surface, loops or strands. Strands are disposed on both sides of a seam of a peripheral strand strip. In this respect, the inner strands are short enough to insure that when they swell owing to the effect of moisture, they bend through approximately 90° in the direction of the surface to be wiped and form a type of brush ring.

16 Claims, 1 Drawing Sheet

FLAT FLOOR-MOP-TYPE COVERING WITH PERIPHERAL BRUSH RING

BACKGROUND

1. Field of the Invention

This invention relates to a flat mop head for cleaning floors comprising a cover plate which, on its upper face, is equipped with means for fastening to a holder and, in the middle of its lower face, with loops or fringes.

2. Discussion of Related Art

There are various known flat mop heads for cleaning floors. The present invention is concerned in particular with moist mop heads, i.e. mop heads suitable for the moist or wet cleaning of floors. Mop heads such as these have to meet a number of requirements. They are expected to take up the cleaning liquid quickly, to transport it to floors without dripping, to transfer it gradually to the floor and to take up the soiled cleaning liquid, so-called dirty water, equally quickly. In addition, they are expected to take up large amounts of solid soil particles, not to give off any fluff and to glide smoothly over the floor. The mop heads are periodically washed through at relatively high temperatures. Accordingly, they are expected to be washable. Finally, the mop heads should be inexpensive to manufacture.

The cleaning-active side, i.e. the underside of the cover plate, may be trimmed with fringes, loops, strips or strands consisting of viscose, cotton, synthetic fibers and blends thereof. The variety of flat mop heads is due to the number of different requirements which, as a rule, cannot be optimally satisfied at one and the same time. If the cleaning-active side, i.e. the underside of the cover plate, consists of fringes, the cleaning performance of the mop head may well be high, but is achieved at the expense of serious fluffing and poor gliding behavior. If mop heads with loops rather than fringes are used, gliding behavior improves and fluffing is reduced but unfortunately cleaning performance falls to an average level. If, on the other hand, the underside of the cover plate consists of a sponge or nonwoven material in the form of several strips arranged in rows alongside one another, hardly any fluff is given off and cleaning performance is very high. In this case, however, the poor gliding behavior is a disadvantage. A cover plate trimmed with strips of the type in question is described, for example, in DE 38 09 279 C1.

The type of fibres used for the underside of the cover plate also influences the cleaning result and the life of the mop heads. Although a high absorption level is achieved with viscose, this material is not suitable for frequent washing at relatively high temperatures. Although cotton is more stable to washing than viscose, it has average absorption. Particularly good stability to washing and hence a long useful life are achieved with an underside of the cover plate of synthetic fibres. Unfortunately, mop heads such as these have no absorption.

For these reasons, the mop head according to DE 32 26 947 A1 has proved to be particularly suitable in practice. It has two zones with different textiles. The middle part of the lower face of the cover plate contains loops of a mixture of synthetic fibers and cotton. They are intended to take up the dirty water with soil dissolved therein. In addition, an encircling textile border of fringes with open yarn ends, which also consist of a blend of synthetic fibers and cotton, is provided at the edges. The fringes are intended to take up soil particles during so-called figure-of-eight wiping where only one of the two longer sides of the rectangular mop head always leads. A further increase in cleaning performance and in useful life and a reduction in manufacturing costs would be advantageous.

3. Summary of the Invention

The technical problem addressed by the invention is to provide an inexpensive flat mop head which is suitable both for dry and for wet/moist cleaning and which, besides good gliding behavior, i.e. low friction on the floor, has a particularly high cleaning performance both for water-soluble soil and for solid soil coupled with a long useful life, i.e. high stability to washing.

According to the invention, this problem is solved by a flat mop head including fringes that are provided on both sides of the seam of an encircling fringe tape, the inner fringes being so short that, when they swell under the effect of moisture, they bend through substantially 90° towards the surface being wiped and form a kind of brush border. A flat mop head such as this has the advantage that the brush border clearly enhances the cleaning effect through its brushing action. Normally, the removal of hairs from wet surfaces is a problem because hairs literally stick to wet surfaces. With the brush border according to the invention, hairs adhere very effectively to the flat mop head. The brush border also has the advantage of a positive influence on the gliding properties of the mop head.

The bending of the fringes caused by swelling under the effect of moisture is extremely effective with a fringe length of 2.5 to 30 mm, but is particularly effective with a fringe length of 5 to 20 mm. If the fringes consist of ring-spun yarn made from a blend of synthetic fibers and cotton, swelling is particularly intense. This applies in particular to a blend of about three quarters PES and about one quarter cotton. Under the effect of the intense swelling, the thread of the seam of the outer fringe tape is very firmly anchored in the seam. In particular, however, the bending effect of the short fringes is more pronounced, the more the fringe yarn swells. The ring-spun yarn with the described composition swells by 65%, for example, after five machine washes at 60° C.

In one advantageous embodiment, the outer fringes are so long that they are able to move freely. This provides for the particularly effective uptake of soil and enables the outer fringe border to penetrate into corners and along skirting boards. In another advantageous embodiment, this length enables the outer fringes to lie particularly effectively on the surface being wiped. These properties can be achieved particularly favorably with a length of 20 to 100 mm. If the fringes have open yarn ends, they are particularly absorbent to soil.

BRIEF DESCRIPTION OF THE DRAWINGS

One example of embodiment of a flat mop head with an encircling fringe border which affords the above-mentioned advantages and other advantages is described in detail in the following with reference to the accompanying drawing in which like items are identified by the same reference designation, wherein.

Figure 1:
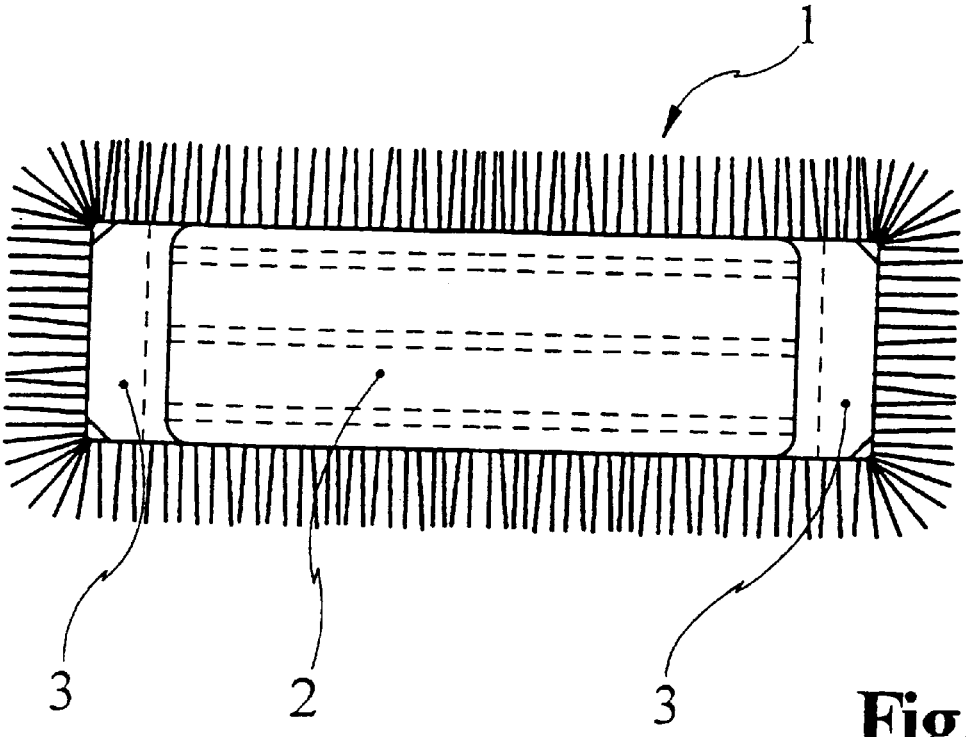
FIG. 1 shows the upper side of the flat mop head.
Figure 2:
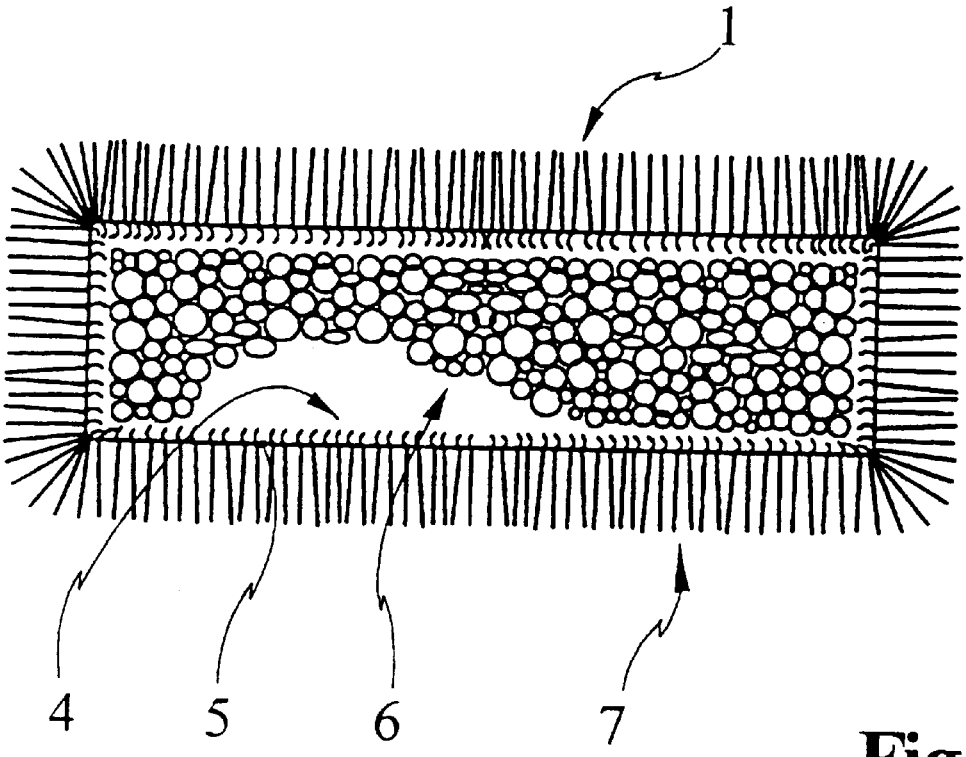
FIG. 2 shows the underside of the flat mop head.

The top view of the upper side of the flat mop head 1 in FIG. 1 shows the cover plate 2 with insertion pockets 3 for a holder of a floor mop. Arranged around the cover plate 2 is a fringe border which, in the present case, consists of the long fringes 7. (See FIG. 2) The top view of the underneath of the flat mop head 1 in FIG. 2 shows the loops 6 in the middle and, around the central loop zone, the encircling fringe tape with the seam 5. The short fringes 4 are shown inside the seams and the long fringes 7 outside the seam 5. The fringe material preferably consists of ring-spun yarn. In ring-spun yarn, the individual filaments are initially parallel. The yarn obtained is then strengthened by real twisting by means of a ring traveler. The end product is a yarn with an ordered parallel fiber structure which does not impede the self-swelling of the fibers. Fleecy, particularly absorbent fibers are the outcome. Mop heads with ring-spun yarn can be up to 25% lighter than those of conventional fibers and yet have the same body, absorption capacity and cleaning performance.

Fringes of oppositely twisted ring-spun yarns are particularly advantageous. If all the individual fibers of the ring-spun yarn are opposite in twist to the individual fibers of the other yarn, the open yarn ends close automatically. It has been found that the open fringes formed by twisting the ring-spun yarn close, particularly during washing, and that frequent washing counteracts disintegration of the fringe ends.

The overall design of the illustrated flat mop head is very advantageous. The inner loop zone 6 acts as a liquid reservoir for accommodating and releasing liquid in use. In addition, the gliding behavior of the mop head is favorably influenced by the loop zone just as it is by the brush border 4. The proposed flat mop head has considerably more favorable performance properties than hitherto known mop heads.

Although various embodiments of the invention have been shown and described herein, those of skill in the art may recognize certain modification thereto, which modifications are meant to be covered by the spirit and scope of the appended claims.

What is claimed is:

1. A flat mop head for cleaning floors, said mop head comprising a cover plate including a top face equipped with means for fastening said cover plate to a holder, and a bottom face with a surface area having a plurality of projections extending therefrom, an encircling fringe tape with a seam, extending peripherally along an edge portion of the surface area of the bottom face, the encircling fringe tape including a plurality of outer fringes extending freely along an outer side of said seam, and a plurality of inner fringes disposed along an inner side of said seam, each of the plurality of inner fringes further including a length shorter than each of the plurality of outer fringes, and each of said plurality of inner fringes being configured to absorb moisture and, upon absorption of moisture, to swell and bend through substantially 90° towards the surface of the floor being cleaned, thereby forming a brush border along the inner side of said seam.

2. A flat mop head as claimed in claim 1 wherein the length of the plurality of inner fringes is between 2.5 and 30 mm.

3. A flat mop head as claimed in claim 2, wherein the plurality of outer and inner fringes consist of ring-spun yarn made from a blend of synthetic fibers and cotton.

4. A flat mop head as claimed in claim 2, wherein the length of the plurality of outer fringes is between 20 and 100 mm.

5. A flat mop head as claimed in claim 2, wherein the plurality of outer and inner fringes have open yarn ends.

6. A flat mop head as claimed in claim 2, wherein the length of the plurality of inner fringes is between 5 mm and 20 mm.

7. A flat mop head as claimed in claim 1, wherein the plurality of outer and inner fringes consist of ring-spun yarn made from a blend of synthetic fibers and cotton.

8. A flat mop head as claimed in claim 7, wherein the ring-spun yarn consists of about three quarters PES and one quarter cotton.

9. A flat mop head as claimed in claim 8, wherein the length of the plurality of outer fringes is between 20 and 100 mm.

10. A flat mop head as claimed in claim 8, wherein the plurality of outer and inner fringes have open yarn ends.

11. A flat mop head as claimed in claim 7, wherein the length of the plurality of outer fringes is between 20 and 100 mm.

12. A flat mop head as claimed in claim 7, wherein the plurality of outer and inner fringes have open yarn ends.

13. A flat mop head as claimed in claim 1, wherein the length of each of the plurality of outer fringes is between 20 and 100 mm.

14. A flat mop head as claimed in claim 13, wherein the plurality of outer and inner fringes have open yarn ends.

15. A flat mop head as claimed in claim 1, wherein the plurality of outer and inner fringes have open yarn ends.

16. A flat mop head as claimed in claim 1, wherein the plurality of projections are selected from the group consisting of loops and fringes.

* * * * *